US005176763A

United States Patent [19]

Byrne et al.

[11] Patent Number: 5,176,763

[45] Date of Patent: * Jan. 5, 1993

[54] METHOD FOR MAKING LITHOPLATE HAVING IMPROVED GRAINABILITY

[75] Inventors: Stephen C. Byrne, Monroeville; John K. McBride, New Kensington, both of Pa.; James R. Weaver, Bettendorf, Iowa

[73] Assignee: Aluminum Company of America, Pittsburgh, Pa.

[ * ] Notice: The portion of the term of this patent subsequent to Jul. 2, 2008 has been disclaimed.

[21] Appl. No.: 724,027

[22] Filed: Jul. 1, 1991

[51] Int. Cl.[5] ..... C22F 1/04

[52] U.S. Cl. ..... 148/692; 148/439; 148/440; 148/695

[58] Field of Search ..... 148/11.5 A, 2, 12.7 A, 148/439, 440, 13, 692, 695

[56] References Cited

U.S. PATENT DOCUMENTS

| | | | |
|---|---|---|---|
| 4,301,229 | 11/1981 | Sakaki et al. | 430/158 |
| 4,377,447 | 3/1983 | Bednarz | 204/15 |
| 4,600,482 | 7/1986 | Mohr | 204/129.4 |
| 4,902,353 | 2/1990 | Rooy et al. | 148/2 |
| 5,028,276 | 7/1991 | Byrne et al. | 148/440 |

*Primary Examiner*—R. Dean
*Assistant Examiner*—Robert R. Koehler
*Attorney, Agent, or Firm*—David W. Pearce-Smith

[57] ABSTRACT

An improved method of treating an ingot to be made into lithoplate. The method also includes (a) providing a non-heat treatable aluminum alloy containing magnesium; (b) homogenizing said alloy; (c) rolling said alloy to form a sheet or plate; (d) heating said sheet or plate for a temperature and time sufficient to permit magnesium to migrate to the surface of said metal; and (e) cold rolling said sheet or plate stock to a finished gauge workpiece.

12 Claims, No Drawings

METHOD FOR MAKING LITHOPLATE HAVING IMPROVED GRAINABILITY

BACKGROUND OF THE INVENTION

This invention relates to a method for making an aluminum lithographic plate which is more commonly identified as lithoplate. More particularly, it relates to an improvement in the method of making a workpiece having improved grainability.

Lithography is defined as the process of printing from a plane surface such as a stone or metal plate on which the image to be printed is ink-receptive and the blank area ink-repellant. The stone or metal plate is referred to as lithoplate, but for purposes of discussing this invention and its background, lithoplate will always refer to metal, or more particularly, an aluminum alloy. In addition, although the term "lithoplate" incorporates the word "plate", lithoplate is not necessarily a plate. Rather, lithoplate is used to describe products that might otherwise be considered to be sheet or foil.

The ink-receptive and ink-repellant areas on lithoplate are developed by subjecting the plate to contact with water in the printing press. The image area is hydrophobic or water-repellant, and the non-image area is hydrophilic or water-retentive. The inks used for printing are such that they will not stick or adhere to wet surfaces and, thus, when the lithoplate is contacted with an ink-laden roller, ink is transferred only to the image area.

It is evident that the quality or suitability of a lithoplate for printing is directly related to the hydrophobic and hydrophilic characteristics of the image and non-image areas. It has long been known that uniform roughening of the surface by a process known as "graining" is advantageous in developing both the hydrophobic and hydrophilic areas.

To make the image area, a lithoplate workpiece is coated with a hydrophobic light-sensitive coating material This material also is resistant to attack or dissolution from acids until it is exposed to light and is commonly called a resist. After the workpiece has been coated with the resist, a negative having the desired image thereon is overlaid on the resist-coated workpiece and exposed to light. In the non-image area, the light causes a reaction in the resist which makes it soluble in acid and, thus, after exposure to light, the plate is contacted with acid to remove the resist in the non-image area. Hydrophobic resist material remains, therefore, only in the image area, and the underlying grained metal surface is advantageous in bonding the resist to it. In the non-image area, with the resist removed, the grained surface is advantageous in enhancing the water retention character of the surface.

Originally, graining of the workpiece was accomplished mechanically by ball graining or brushing. In ball graining, a slurry of steel balls and abrasive material is agitated on the workpiece with the extent of roughening controlled by such things as the type of abrasive, number of balls, speed of agitation, etc. In brush graining, brushes are rotated or oscillated over the surface covered with an abrasive slurry. Mechanical graining usually requires cleaning the plate to make it suitable for further processing. Typically, cleaning is accomplished by immersion in a commercial caustic type solution It is evident that uniformity and quality of the roughened surface is difficult to control with such methods In addition, mechanical graining may be relatively slow and costly.

Because of difficulties in mechanical graining, the constant growth of lithographic printing, higher operating speeds of modern printing presses, need for longer lithoplate life, etc., increasing attention has been given to chemical and electrochemical methods of graining. By these methods, the grain is produced by a controlled etching of the surface by the use of chemicals alone or the combination of passing current through a chemical solution. U.S. Pat. Nos. 4,301,229, 4,377,447 and 4,600,482 are cited as examples of many that are directed to electrochemically graining. Whether mechanically grained or electrochemically grained, lithoplate workpieces have certain requirements in common. Lithoplate is used in light gauges, such as 0.008 or 0.012 inch, for example, and by the nature of its use, it must be relatively flat. The surface should be free of imperfections such as deep gouges, scratches and marks which would interfere with the production of a uniform grained surface. From the standpoint of economics or commercial utilization in making aluminum lithoplate, it is desirable that it be produced from an aluminum alloy which can be rolled to the light gauges noted above at reasonable production rates and reasonable levels of recovery or scrap loss. It is also desirable that the alloy from which the lithoplate is made be one which produces reasonably uniform grain when rolled to finished gauge.

In addition, it has become a common practice to apply an anodized finish to the grained surface, whether mechanically or electrochemically produced. It is desirable, therefore, that the aluminum alloy and fabricating practices used to make lithoplate be such that the sheet responds well to anodizing; that is, be uniform in color and relatively free from streaks.

Heretofore, a number of aluminum alloys have been tried and evaluated for the commercial production of lithoplate to be mechanically grained, and the most widely used alloys today are 3000 and 1000 series commercial Aluminum Association alloys (3XXX and 1XXX). In consideration of all of the foregoing lithoplate requirements, these alloys have been determined to be the best from the sheet manufacturer and lithoplate maker or user point of view. With respect to electrochemical graining, however, the response of an aluminum alloy to the particular chemicals employed is obviously an important factor, and these alloys are generally not preferred for graining by such methods.

It would be desirable, therefore, to provide a workpiece fabricated from non-heat treatable alloys such as 3000, 1000 and 5000 series commercial Aluminum Association alloys which would be suitable for graining by either a chemical or electrochemical method.

SUMMARY OF THE INVENTION

By a method of this invention, an aluminum alloy containing magnesium is cast into an ingot which is homogenized, preheated before being hot rolled, cold rolled, subjected to a high temperature anneal, scalped and cold rolled to a relatively thin gauge as a lithoplate workpiece. The workpiece may then be chemically or electrochemically grained to produce a suitable surface for lithographic printing. If desired, the grained surface may be anodized.

More specifically the method of the present invention involves treating an ingot to be made into lithoplate. The method also includes (a) providing a non-heat treatable aluminum alloy containing magnesium; (b) homogenizing said alloy; (c) rolling said alloy to form a sheet or plate; (d) heating said sheet or plate for a temperature and time sufficient to permit magnesium to migrate to the surface of said metal; and (e) cold rolling said sheet or plate stock to a finished gauge workpiece.

A preferred embodiment of the invention includes (a) providing a non-heat treatable aluminum alloy containing at least 0.1 weight percent magnesium; (b) heating said alloy to a temperature of 1075°-1200° F. for at least 4 hours; (c) rolling said alloy to form a sheet or plate; (d) heating said sheet or plate above approximately 700° F. for at least 1 hour; and (e) cold rolling said sheet or plate stock. In a most preferred embodiment, step (b) is performed for less than 8 hours.

A method of this invention is an improvement over methods known heretofore for making lithoplate by controlling the time and temperature of a high temperature batch anneal so as so to cause the migration of magnesium towards the surface of the metal. It is believed that the heating need not be sufficient to cause all of the magnesium to migrate to the surface of the metal.

As will be discussed in greater detail below, in the preferred method of the invention the high temperature anneal is performed prior to the final cold rolling the reroll stock to finish gauge using practices appropriate for producing a lithoplate workpiece. The workpiece thus produced is then grained by a chemical or electrochemical method to develop a desired grain and the grained surface may then be anodized.

A lithoplate produced by a method of this invention which includes anodizing the grained surface to form a surface that is substantially streak-free and substantially free of ungrained areas. Although streaks in the anodized finish usually have no adverse effect on the printing function of the lithoplate, streaks are undesirable from a commercial point of view because many lithoplate users consider the presence of streaks to be an indication of an inferior lithoplate and will not accept a lithoplate unless it has a substantially uniform appearance.

A lithoplate produced by a method of this invention may be provided with a grain which is substantially uniform in depth and color by either mechanically or electrochemically graining.

It is an objective of a method of this invention to make a lithoplate which has a substantially uniform electrochemically grained finish.

It is an advantage of a method of this invention that lithoplate may be produced from a single alloy which is suitable for graining by mechanical or electrochemical methods.

These and other objectives and advantages of the present invention will be more apparent with reference to the following description of a preferred embodiment and the appended claims.

DESCRIPTION OF A PREFERRED EMBODIMENT

The aluminum alloy for use in a method of this invention is predominantly aluminum but includes magnesium, silicon, iron and may include other elements as well. As noted earlier, the non-heat treatable commercial Aluminum Association alloys for making a lithoplate are 1000, 3000 and 5000 series alloys containing magnesium. The minimum amount of magnesium that is need to bring about the desired results is not known however it is believed that alloys containing at least 0.1 magnesium that are used in making lithoplate will benefit from the process of the present invention.

It is known that 3005 alloy containing magnesium is suitable for rolling into sheets to receive an anodized finish. However, the chemical grainability of the 3005 alloy has not been found to be ideal for some applications. Surprisingly, if 3005 is subjected to a high temperature intermediate anneal the grainability of the alloy improves. The term "high temperature" is used herein to refer to a temperature at which transition oxides of alumina will form. The term "batch anneal" is used herein to refer to a non-continuous anneal. The term "intermediate anneal" is used herein to refer an anneal that is performed before rolling to final gauge.

For purposes of this invention, it is preferred that casting of the ingot be controlled to produce an homogenous structure. This may be accomplished by use of a proper grain refiner when DC casting an ingot, control of casting conditions employing appropriate molten metal treatment practices, i.e., fluxing and filtration, to remove nonmetallic inclusions and using a proper casting speed and maintenance of a suitable depth of molten metal while casting, controlling the temperature of casting the ingot. All of the foregoing variables in casting and preparing an ingot for hot rolling are important in producing a satisfactory sheet to make lithoplate by a method of this invention and preferred parameters of each of these variables is well known to those skilled in the art and need not be discussed in great detail.

Removal of undesirable nonmetallic inclusions such as oxides, carbides, etc., in the molten metal is also important in a process of this invention to prevent such nonmetallic inclusions from being cast into the ingot. Suitable methods for removing nonmetallic inclusions are known in the art, such as fluxing the molten bath with an active gas such as chlorine, and/or passing the molten metal through filters prior to casting, for example.

The remaining factor to be controlled with respect to casting homogenizing and preheat of the ingot is the temperature. It should be cast at a relatively high incoming temperature; that is, 1310°±20° F. The homogenizing and preheat temperatures employed prior to hot rolling the ingot not critical to practicing the present invention. However, as discussed below, extending the preheat time from a standard practice will enhance the effect of the intermediate anneal.

Preferably, the ingot is homogenized at a relatively high temperature to assist in developing a fine uniform microstructure in order to develop a fine uniform surface on the sheet. For 3005 alloy, the homogenization temperature and time should be 1110°±20° F. for a time sufficient to homogenize, such as approximately 4 hours, for example. The ingot should then be cooled to a temperature of 905° F. or less at a rate of 68° F./hour. Below 905° F., the cooling rate is not critical and the ingot may be allowed to cool to room temperature if desired.

After the ingot has been homogenized as just described, it should be scalped preliminary to hot rolling. The depth of scalp may vary but should be of sufficient depth to remove the zone of metal, generally referred to as the disturbed zone, which includes coarse dendrite cells and "fir tree" or "dendritic" structure, for example. For a typical DC cast ingot, the scalp is typically ¾ inch/side.

The ingot is then preheated to bring it to the proper rolling temperature. The initial set temperature in preheating should be approximately 1100° F. ±20° F. to insure that it is completely heated, and thereafter the ingot should be allowed to cool to an initial rolling temperature of 860°±30° F. and maintained at that temperature for one hour. The holding temperature need be only that necessary to uniformly heat the ingot. The ingot is then hot rolled and cold rolled.

All of the foregoing steps relate to practices that are well known to those skilled in the art of casting and hot rolling ingot. Each of the foregoing steps is related to metallurgical control of the ingot to be used in rolling a lithosheet which will respond to graining and application of an anodized finish to produce a surface adequate for lithosheet; that is, having a uniform grained surface which is substantially free from streaks or other defects attributable to metallurgical flaws.

After hot rolling the ingot is cold rolled to a gauge of typically about 0.063 inches, the sheet or plate is subjected to an intermediate anneal. The anneal is at a temperature above that at which magnesium will migrate to the metal/oxide interface. The migration will begin at about 700° F. It is believed that heating to at least 700° F. for at least 1 hour will furnish sufficient heat to produce the amount of magnesium migration required for the present invention to work. A preferred annealing temperature and time is 750° F. for 2 hours and a most preferred annealing temperature and time is 800° F. for 2 hours. Those skilled in the art will understand that the maximum upper limit of the intermediate anneal is the liquidus temperature of the alloy.

After the high temperature intermediate anneal, the sheet is cooled to and rolled to 0.0116 inch, which is the final gauge.

After the sheet has been fabricated as just discussed, at least one side is grained by either a chemical or electrochemical method. A workpiece made by a method of this invention is suitable for graining either chemically or electrochemically. Pieces were grained by immersion in an electrolytic acid bath and were then processed and anodized using practices and procedures which are known to those skilled in the art. Craters on the sample produced by a method of this invention are more uniform in size and more evenly distributed over the surface than samples of the same alloy without the benefit of the high temperature anneal of the present invention.

The following examples illustrate the preferred method of practicing the present invention and the advantage of the present invention over the prior art.

EXAMPLE 1 (PRIOR ART)

An sheet of 3005 aluminum alloy is made by hot rolling to 0.250 inches and cold rolling to 0.063 inches. The sheet is then subjected to a standard anneal to demonstrate the condition of prior art lithoplate. An anneal is performed by heating the sheet to 665° F. at a rate of 80° F. per hour and holding it at 665° F. for 2 hours. Afterwards the sheet is cooled at a rate of 80° F. per hour until it reaches 450° F. and then air cooled and cold rolled to a final workgauge of 0.0116 inches. The surface of one side of the sheet was electrochemically grained.

The electrochemical activity of the surfaces was determined by cyclic potentiodynamic anodic polarization (PAP) in a 1 molar NaCl electrolyte according to ASTM Standard G 61-78. The data is generated using a PARC 173 potentiostat, PARC 175 universal programmer and an analog X-Y recorder. The working electrodes were prepared by cleaning the samples with acetone, attaching an electrical contact by percussion weld and masking off the electrode area with an electroplater's lacquer. The electrode area was 0.25 sq. cm.

The polarization curves were measured from −950 mV to −600 mV vs. the saturated calomel reference electrode (SCE). Four successive cyclic sweeps between these potentials were made for each sample. Evaluations included examination of the general shape of curves, the value of the breakdown potential, the value of the passive current density and the electrode surfaces are evaluated via visual examination. The cyclic PAP measurements and the results of the visual examination for this example and subsequent Examples 2-8 are shown in the Table. As a general rule, the better lithosheet substrates have more negative cyclic PAP measurements.

TABLE

| Example No. | Presoak Time (hrs) | Presoak Temp (°F.) | Anneal Time (hrs) | Anneal Temp (°F.) | Cyclic PAP* | Visual Rating |
|---|---|---|---|---|---|---|
| 1 | 4 | 1120 | 2 | 665 | −750 | C− |
| 2 | 4 | 1120 | 2 | 620 | −760 | D |
| 3 | 4 | 1120 | 2 | 750 | −775 | A |
| 4 | 4 | 1120 | 2 | 800 | −785 | A |
| 5 | 8 | 1120 | 2 | 665 | −765 | B |
| 6 | 8 | 1120 | 2 | 600 | −760 | B |
| 7 | 8 | 1120 | 2 | 750 | −790 | A |
| 8 | 8 | 1120 | 2 | 800 | −815 | A |

*Cyclic Potentiodynamic Anodic Polarization measurement ASTM G61-78

EXAMPLE 2

A sample of the same sheet of 3005 aluminum alloy as used in Example 1 except that the alloy is subjected to an intermediate anneal at a lower temperature than the anneal of Example 1. The anneal is performed by heating the sheet to 600° F. at a rate of 80° F. per hour and holding it at 600° F. for 2 hours. Afterwards the sheet is water quenched and cold rolled to a final workgauge of 0.0116 inches. The surface of one side of the sheet was electrochemically grained.

The results of the PAP measurement and the visual rating of the surface are shown in the Table. Although the material of Example 2 exhibits a more negative cyclic PAP measurement, the visual rating of the surface ("D") indicates that it is inferior to the prior art material of Example 1.

EXAMPLE 3

A sample of the same sheet of 3005 aluminum alloy as used in Example 1 except that the alloy is subjected to an anneal of the present invention. The anneal is performed by heating the sheet to 750° F. at a rate of 80° F. per hour and holding it at 750° F. for 2 hours. Afterwards the sheet is cooled at a rate of 50° F. per hour until it reaches 450° F. and then air cooled and cold rolled to a final workgauge of 0.0116 inches. The surface of one side of the sheet was electrochemically grained.

The results of the PAP measurement and the visual rating of the surface are shown in the Table. The superior PAP measurement (increased negative number) and the subjective rating of the surface of the sheet as "A" due to the uniformity of size and evenness of distribution of craters on a sheet produced by a process of this invention is surprising and unexpected.

EXAMPLE 4

A sample of the same sheet of 3005 aluminum alloy as used in Example 1 except that the alloy is subjected to an anneal of the present invention. The anneal is performed by heating the sheet to 800° F. at a rate of 80° F. per hour and holding it at 800° F. for 2 hours. Afterwards the sheet is cooled at a rate of 80° F. per hour until it reaches 450° F. and then air cooled and cold rolled to a final workgauge of 0.0116 inches. The surface of one side of the sheet was electrochemically grained.

The results of the PAP measurement and the subjective rating of the surface are shown in the Table. The superior PAP measurement (increased negative number) and the subjective rating of the surface of the sheet as "A" due to the uniformity of size and evenness of distribution of craters on a sheet produced by a process of this invention is surprising and unexpected.

EXAMPLE 5

A sample of the same sheet of 3005 aluminum alloy as used in Example 1 except that the presoak time is extended from 4 hours to eight hours. The results of the PAP measurement and the subjective rating of the surface are shown in the Table. The superior PAP measurement (increased negative number) and the subjective rating of the surface of the sheet as "B" due to the uniformity of size and evenness of distribution of craters on a sheet produced by a process of this invention is surprising and unexpected.

EXAMPLE 6

A sample of the same sheet of 3005 aluminum alloy as used in Example 1 except that the alloy is subjected to an intermediate anneal at a lower temperature than the standard anneal (as in Example 2) and the presoak time is extended from 4 hours to 8 hours (as in Example 5). The surface of one side of the sheet was electrochemically grained and the results of the PAP measurement and the subjective rating of the surface are shown in the Table. The superior PAP measurement (increased negative number) and the subjective rating of the surface of the sheet as "B" due to the uniformity of size and evenness of distribution of craters on a sheet produced by a process of this invention is surprising and unexpected.

EXAMPLE 7

A sample of the same sheet of 3005 aluminum alloy as used in Example 1 except that the alloy is subjected to an intermediate anneal at 750° F. (as in Example 3) and the presoak time is extended from 4 hours to 8 hours (as in Example 5 and 6). The surface of one side of the sheet was electrochemically grained and the results of the PAP measurement and the subjective rating of the surface are shown in the Table. The superior PAP measurement (increased negative number) and the subjective rating of the surface of the sheet as "A" due to the uniformity of size and evenness of distribution of craters on a sheet produced by a process of this invention is surprising and unexpected.

EXAMPLE 8

A sample of the same sheet of 3005 aluminum alloy as used in Example 1 except that the alloy is subjected to an intermediate anneal at 800° F. (as in Example 3) and the presoak time is extended from 4 hours to 8 hours (as in Example 5-76). The surface of one side of the sheet was electrochemically grained and the results of the PAP measurement and the subjective rating of the surface are shown in the Table. The superior PAP measurement (increased negative number) and the subjective rating of the surface of the sheet as "A" due to the uniformity of size and evenness of distribution of craters on a sheet produced by a process of this invention is surprising and unexpected.

It is to be appreciated that the invention is susceptible to a number of modifications without departing from the present invention. Thus, for example, the lithoplate alloy need not be 3005. Other lithoplate alloys are also contemplated as being within the scope of the invention. Other lithoplate alloys include 3000 series, 1000 series and 5000 series alloys which contain magnesium. Preferred alloys will contain at least 0.1 percent magnesium and the most preferred alloys will contain at least 0.1 percent magnesium.

Furthermore, it is contemplated that those skilled in the art will recognize that temperatures other than 750° F. and 800° F. can be used in practicing the present invention. The temperature used must be above the temperature at which migration of magnesium in the sheet and plate will occur. It addition, this temperature will need to be maintained for a time sufficient to allow the magnesium to migrate to the surface. The time and temperature used will depend in part on the composition of the alloy, including the magnesium content, and production time/cost constraints.

In addition, the length of time that the sheet will need to be kept at a high temperature will depend on the temperature that is used. For example, at 800° F., the magnesium migration will be relatively quicker than at 750° F. Thus, when one processes the alloys at 800° F., it does not need to be held as long to effect the same amount of magnesium migration as sheet annealed at 750° F. It is believed that an anneal of 2 hours at 800° F. is for a much longer period of time than is needed to derive the benefit of the present invention.

Finally, even though the invention has been described in terms of a batch anneal process in which the entire piece of metal is placed in furnace and held for a predetermined time at a predetermined temperature, other annealing processes may also be used. Thus, for example, a continuous or semi-continuous anneal maybe employed in practicing the present invention. In a continuous anneal the sheet is continuously entering and exiting the annealing furnace and only a portion of the metal sheet is at the maximum temperature.

While the invention has been described in terms of preferred embodiments, the claims appended hereto are intended to encompass all embodiments which fall within the spirit of the invention. The scope of the present invention is indicated by the broad general meaning of the terms in which the claims are expressed.

What is claimed is:

1. A method for producing an aluminum lithoplate comprising:

(a) providing a non-heat treatable aluminum alloy containing at least 0.1 weight percent magnesium;

(b) heating said alloy to a temperature of 1075°-1200° F. for at least 4 hours;

(c) rolling said alloy to form a sheet or plate;

(d) heating said sheet or plate above approximately 700° F. for at least 1 hour; and (e) cold rolling said sheet or plate stock to a finished gauge workpiece.

2. A method as claimed in claim 1 in which step (d) includes heating said sheet or plate above approximately 750° F. for at least 2 hours.

3. In The production of lithoplate sheet or plate wherein at least one side of an aluminum alloy sheet is chemically or electrochemically grained, the improvement wherein said sheet or plate is produced by:

heating a sheet of a non-heat treatable aluminum alloy containing at least 0.1 weight percent magnesium above a temperature of 700° F. and maintaining said temperature for at least one hour to cause the migration of said magnesium towards the interface between the surface of the metal and the native oxide layer.

4. A method as claimed in claim 3 in which said heating includes heating said sheet or plate above approximately 700° F. for at least 2 hours.

5. A method for producing a crystalline grain structure beneath the surface of the oxide layer of an aluminum lithoplate alloy comprising the steps of:

(a) providing a non-heat treatable aluminum lithoplate alloy containing magnesium and rolling it a predetermined gauge; and (b) heating said alloy for above approximately 700° F. for at least 1 hour.

6. A method as claimed in claim 5 in which step (a) includes heating said alloy to a temperature of 1075°-1200° F. for at least 4 hours prior to rolling to said predetermined gauge.

7. A method as claimed in claim 5 in which step (b) includes heating said sheet or plate above approximately 750° F. for at least 2 hours.

8. A method as claimed in claim 5 which further includes (c) cold rolling said sheet or plate stock to a finished gauge workpiece.

9. A method for treating aluminum to provide a roughened surface thereon suitable for lithographic uses, said method comprising the steps of:

forming an ingot of a non-heat treatable aluminum alloy containing at least 0.1 weight percent magnesium;

homogenizing said ingot for a period of time suitable to insure homogenization of the ingot;

rolling said ingot to form reroll stock;

heating said reroll stock above approximately 700° F. for at least 2 hours to cause migration of said magnesium towards the surface of said ingot;

cold rolling the reroll stock to a finished gauge workpiece; and providing means for graining at least one surface of the workpiece.

10. A method as claimed in claim 9 in which said rolling step includes:

hot rolling and then cold rolling said ingot.

11. A method for producing an aluminum lithoplate comprising:

(a) providing a non-heat treatable aluminum alloy containing at least 0.1 weight percent magnesium;

(b) heating said alloy to a temperature of 1075°-1200° F. for at least 4 hours;

(c) rolling said alloy to form a sheet or plate;

(d) heating said sheet or plate above approximately 700° F. for at least 1 hour; and (e) cold rolling said sheet or plate stock.

12. A method as claimed in claim 11 in which step (d) includes heating said sheet or plate above approximately 750° F. for at least 2 hours.

* * * * *